US006486748B1

(12) United States Patent
Stones et al.

(10) Patent No.: US 6,486,748 B1
(45) Date of Patent: Nov. 26, 2002

(54) SIDE ENTRY E-PLANE PROBE WAVEGUIDE TO MICROSTRIP TRANSITION

(75) Inventors: David I. Stones, Torrance, CA (US); Jerry M. Dickson, Memphis, TN (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/256,713

(22) Filed: Feb. 24, 1999

(51) Int. Cl.[7] ..... H01P 5/107
(52) U.S. Cl. ..... 333/26; 333/33; 333/34
(58) Field of Search ..... 333/26, 34, 33

(56) References Cited

U.S. PATENT DOCUMENTS

| | | | | | |
|---|---|---|---|---|---|
| 4,453,142 | A | | 6/1984 | Murphy | 333/26 |
| 4,550,296 | A | | 10/1985 | Ehrlinger et al. | 333/26 |
| 4,851,794 | A | | 7/1989 | Williams et al. | 333/33 |
| 5,198,786 | A | | 3/1993 | Russell et al. | 333/26 |
| 5,202,648 | A | | 4/1993 | McCandless | 333/26 |
| 5,235,300 | A | | 8/1993 | Chan et al. | 333/247 |
| 5,319,329 | A | | 6/1994 | Shiau et al. | 333/204 |
| 5,396,202 | A | | 3/1995 | Scheck | 333/230 |
| 5,414,394 | A | | 5/1995 | Gamand et al. | 333/26 |
| 5,440,279 | A | * | 8/1995 | Kinoshita et al. | 333/26 |
| 5,539,361 | A | | 7/1996 | Davidovitz | 333/26 |
| 5,559,480 | A | | 9/1996 | Ivanivsky | 333/21 R |
| 5,585,768 | A | * | 12/1996 | Wei | 333/26 X |
| 5,600,286 | A | | 2/1997 | Livingston et al. | 333/26 |
| 5,726,664 | A | | 3/1998 | Park et al. | 343/705 |
| 5,912,598 | A | * | 6/1999 | Stones et al. | 333/26 |
| 5,982,250 | A | * | 11/1999 | Hung et al. | 333/26 |
| 6,028,497 | A | * | 2/2000 | Allen et al. | 333/26 X |

FOREIGN PATENT DOCUMENTS

| | | | | |
|---|---|---|---|---|
| JP | 49003 | * | 3/1984 | 333/26 |
| JP | 77403 | * | 4/1986 | 333/26 |
| JP | 405335815 | | 12/1993 | 333/26 |

OTHER PUBLICATIONS

S.S. Moochalla, C. An, "*Ridge Waveguide Used in Microstrip Transition*", Microwaves and RF, Mar. 1984.

W. Menzel and A. Klaassen, "*On the Transition from Ridged Waveguide to Microstrip*", Proc. 19$^{th}$ European Microwave Conf., pp. 1265–1269, 1989.

L.J. Lavedan, "*Design of Waveguide–to–Microstrip Transitions Specially Suited to Millimetre–Wave Applications*", Electronic Letters, vol. 13, No. 20, pp. 604–605, Sep. 1977.

T.Q. Ho and Y. Shih, "*Spectral–Domain Analysis of E–Plane Waveguide to Microstrip Transitions*", IEEE Trans. Microwave Theory and Tech., vol. 37, pp. 388–392, Feb. 1989.

D.I. Stones, "*Analysis of a Novel Microstrip–to–Waveguide Transition/Combiner*", IEEE MTT–S Int'l Symposium Digest, San Diego, Ca, vol. 1, pp. 217–220, 1994.

B.N. Das, K.V.S.V.R. Prasad, and S. Rao, "*Excitation of Waveguide by Stripline– and Microstrip–Line–Fed Slots*", IEEE Trans. Microwave Theory and Tech., vol. 34, pp. 321–327, Mar. 1986.

R.E. Collin, "*Field Theory of Guided Waves*", McGraw–Hill, New York, ch. 8, 1960.

L. Hyvonen and A. Hujanen, "*A Compact MMIC–Compatible Microstrip to Waveguide Transition*", IEEE MTT–S Int's Symposium Digest, San Francisco, Ca, vol. 2, pp. 875–878, 1996.

* cited by examiner

*Primary Examiner*—Benny Lee
(74) *Attorney, Agent, or Firm*—Harness, Dickey & Pierce, P.L.C.

(57) ABSTRACT

A waveguide-to-microstrip transition (30) for converting and directing electromagnetic wave signals to an electronic signal processing component (53). A waveguide (32) directs the signals to a waveguide input and is received by a probe (36). A bent microstrip line (40A) which is connected to the probe (36) directs the received signals from the probe (36) to the electronic signal processing component (53). An output port (43) provides a connection between the bent microstrip line (40A) and the electronic signal processing component (53). The output port (43) is not inline with respect to the probe (36), but the microstrip line (40A) includes a bend so as to direct the received signals from the probe (36) to the output port (43).

15 Claims, 13 Drawing Sheets

SIDE ENTRY E-PLANE PROBE WAVEGUIDE TO MICROSTRIP TRANSITION

BACKGROUND OF THE INVENTION

1. Field of the Invention

The present invention is generally related to monolithic microwave/millimeter waveguide devices and more particularly to packaging waveguide-to-microstrip transitions for microwave/millimeter waveguide devices.

2. Discussion

In the past, several waveguide-to-microstrip design methodologies have been proposed in an effort to introduce an efficient transition from waveguide to microstrip. The need for such a transition is prompted by the numerous applications it has in present mm-wave (mmW) and microwave/millimeter wave integrated circuit (MMIC) technologies. The increased use of low-cost MMIC components such as low-noise and power amplifiers, in both military and commercial systems continues to drive the search for more affordable and package-integrable transitions.

The current method of signal reception and power transmission within the mmW system is the rectangular waveguide which has a relatively low insertion loss and high power handling capability. In order to keep the overall package cost to a minimum, there is a need for a transition which is mechanically simple and easily integrated into the housing while maintaining an acceptable level of performance.

Current designs have used transitions which were based on stepped ridged waveguides as discussed, for example, in: S. S. Moochalla and C. An, "*Ridge Waveguide Used in Microstrip Transition*", Microwaves and RF, March 1984; and W. Menzel and A. Klaassen, "*On the Transition from Ridged Waveguide to Microstrip*", Proc. 19th European Microwave Conf., pp. 1265–1269, 1989. Other designs used antipodal finlines which were discussed, for example, in: L. J. Lavedan, "*Design of Waveguide-to-Microstrip Transitions Specially Suited to Millimeter-Wave Applications*", Electronic Letters, vol. 13, No. 20, pp. 604–605, September 1997.

Moreover, current designs have used probe coupling which was discussed, for example, in: T. Q. Ho and Y. Shih, "*Spectral-Domain Analysis of E-Plane Waveguide to Microstrip Transitions*", IEEE Trans. Microwave Theory and Tech., vol. 37, pp. 388–392, Febuary 1989; and D. I. Stones, "*Analysis of a Novel Microstrip-to-Waveguide Transition/Combiner*", IEEE MTT-S Int'l Symposium Digest, San Diego, Calif., vol. 1, pp. 217–220, 1994.

These current designs suffer from such disadvantages as varying degrees of mechanical complexity. Some of the current transitions are bulky and use several independent pieces that must be assembled in various steps. Additionally, they may require more than one substrate material with multilevel conductors and high-tolerance machining of background housing components such as waveguide steps/tapers, or precise positioning of a backshort. Such precise positioning requirements produce extensive bench tuning after fabrication. Also, current designs require a separate waveguide window and several hermetic sealing process steps to achieve hermetic sealing of the component. These disadvantages render current designs expensive and difficult to integrate into the package.

Additionally, current designs include probes which sample a waveguide signal within a waveguide cavity by either sampling in the E-Plane of the H-Plane direction of propagation. However, these probes limit the placement of connecting microwave hardware to be inline with the probe direction. Such an approach limits the where the output port is located within the component.

SUMMARY OF THE INVENTION

A waveguide-to-microstrip transition for processing electromagnetic wave signals includes a waveguide for directing the signals to a waveguide input. A substrate covers the waveguide input and is hermetically sealed to the waveguide. A probe on the substrate overlies the waveguide input.

In another embodiment, the waveguide-to-microstrip transition includes an iris connected to the substrate for substantially matching the impedance between the probe and a microstrip line.

In still another embodiment, a microstrip line includes a bend so as to direct signals from a probe to a side output port which is not substantially inline with the probe.

Additional advantages and features of the present invention will become apparent from the subsequent description and the appended claims, taken in conjunction with the accompanying drawings in which:

DETAILED DESCRIPTION OF THE PREFERRED EMBODIMENTS

Figure 1:
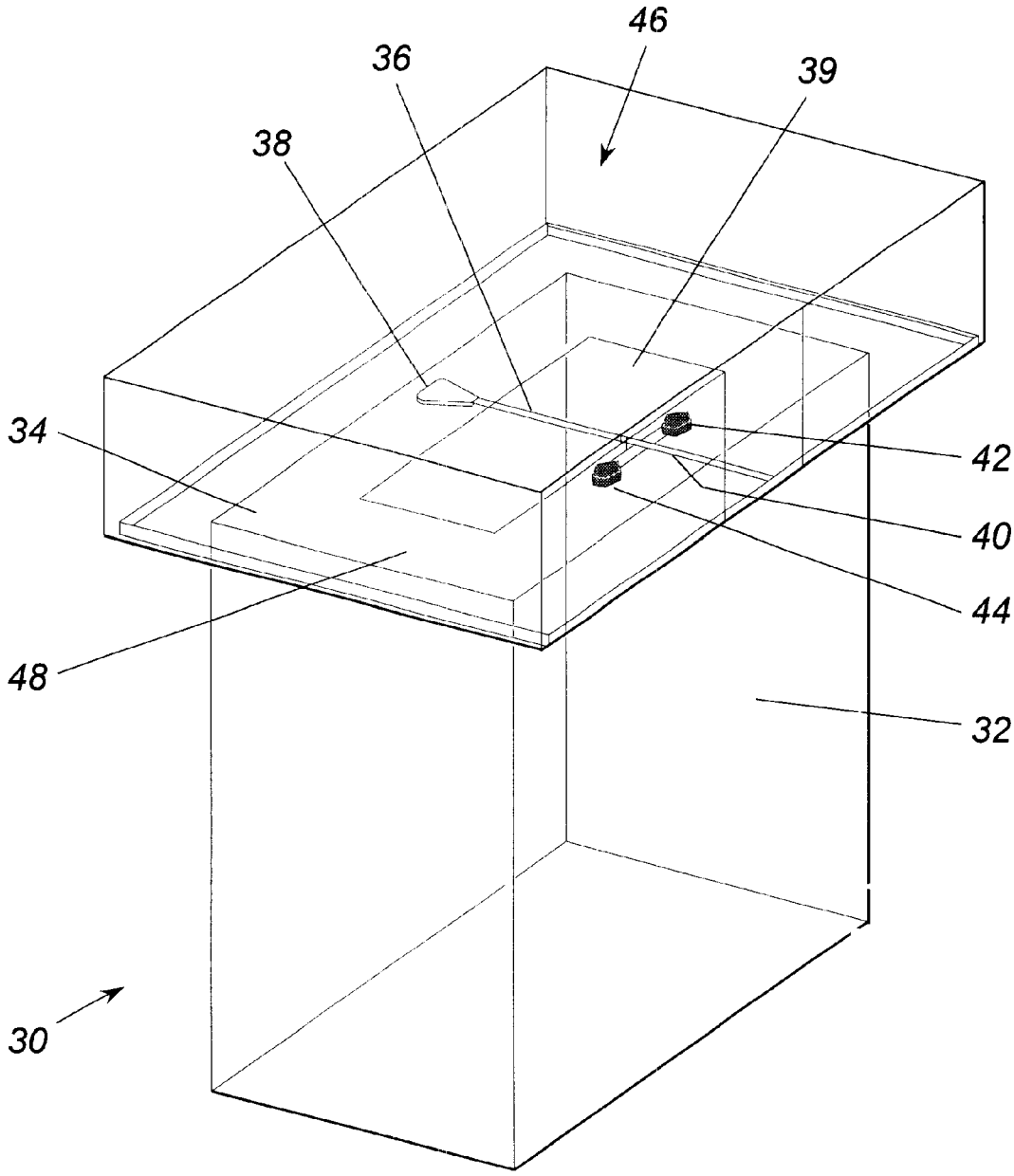
FIG. 1 is a diagrammatic perspective of the waveguide-to-microstrip transition.

In the discussion of the embodiments below, like reference numerals represent like elements throughout the figures. Referring to FIG. 1, a waveguide-to-microstrip transition package is generally shown at 30. The opening of waveguide 32 allows electromagnetic millimeter/ microwave signals to reach substrate 34. A probe 36 is etched onto the top of substrate 34. Probe 36 terminates with a first stub 38. Transition 39 indicates where probe 36 transitions into a microstrip line 40. Microstrip line 40 has a second stub 42 and a third stub 44; both stubs can be either an open or a shorted element. Above substrate 34 is a cavity 46, and below substrate 34 is an iris 48.

Figure 2:
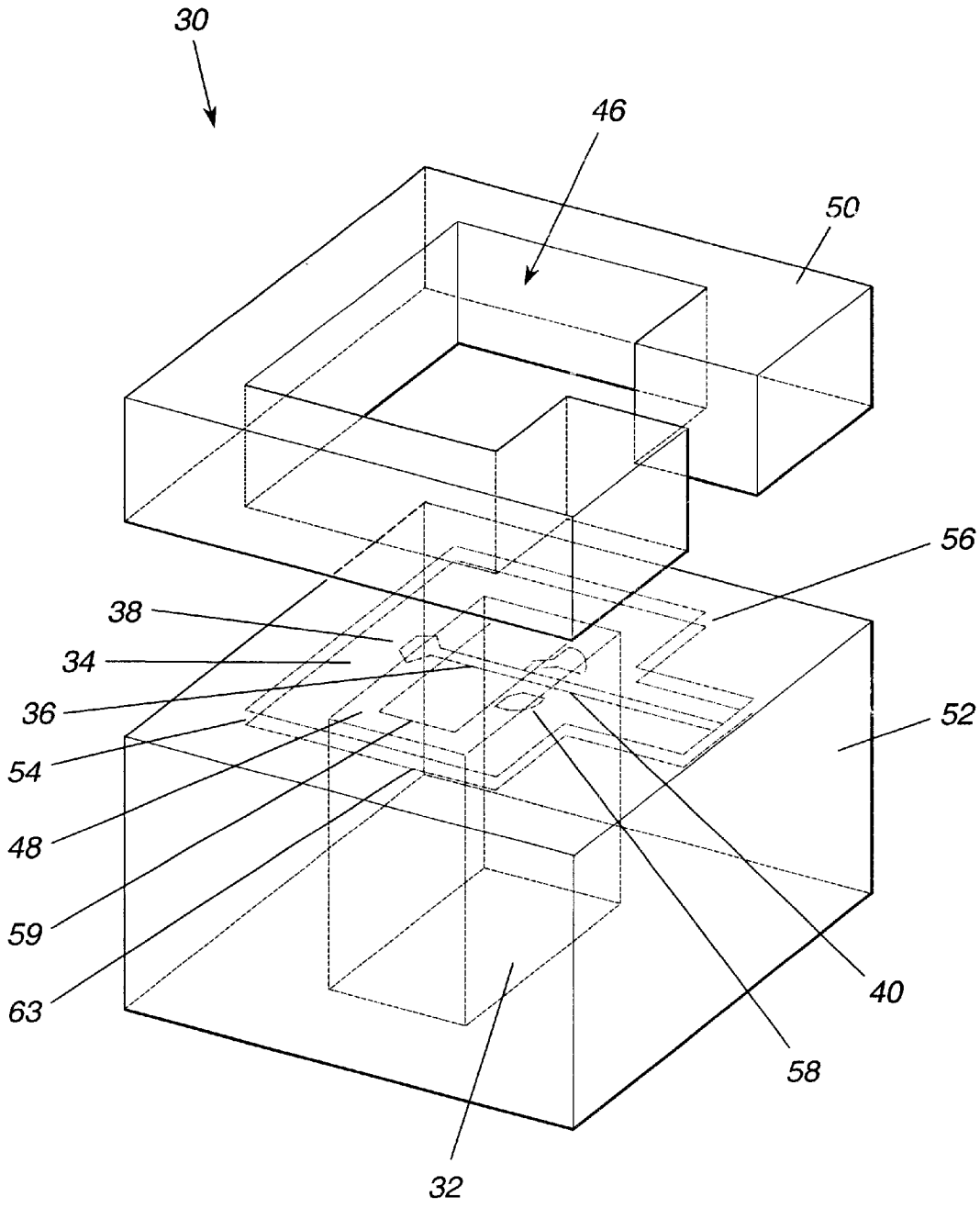
FIG. 2 is a diagrammatic perspective of the waveguide-to-microstrip transition wherein the internal portions of the package are revealed.

FIG. 2 shows the package 30 with its internal structure revealed. A ring frame 50 which is placed on top of base 52 defines cavity 46. Probe 36 which is etched on the backside of substrate 34 eliminates the need for separate assembly steps for the substrate-to-probe adhesion. The etching can be done by a photolithographic or other such process known in the art. Substrate 34 is self-aligning as indicated at location 54 which is advantageous particularly for applications requiring tight tolerances such as W-band packaging applications.

Substrate 34 overlaps waveguide input 63 which makes a natural hermetic seal as indicated at location 56. Iris 48 on waveguide input 63 provides matching between probe 36 and waveguide input 63 as shown at location 58. In addition, iris 48 allows the formation of a cavity 46 above the probe 36, resulting in the backshort length to be a less critical dimension. Location 59 depicts the elimination of glass-to-metal seal contact to substrate.

Figure 3:
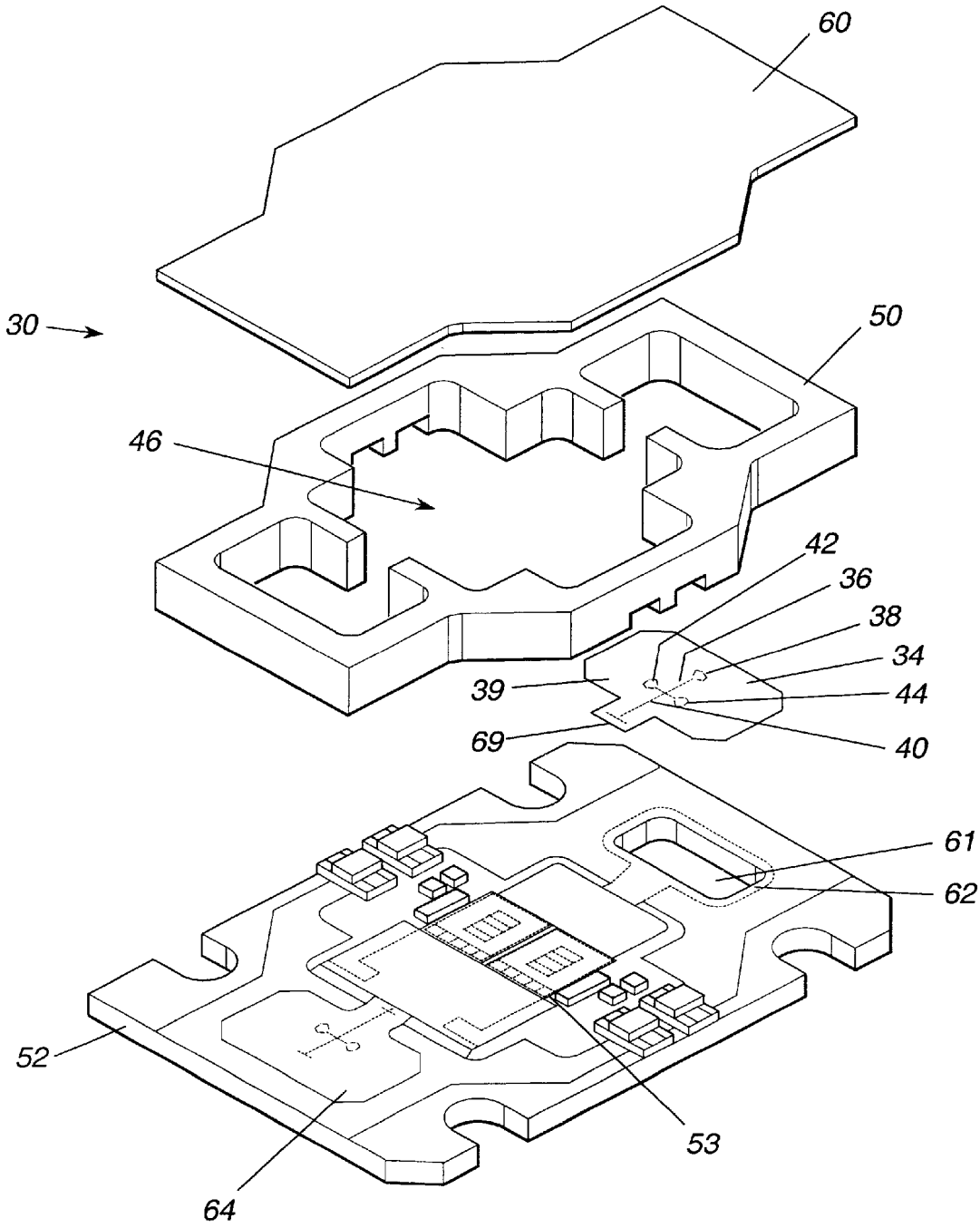
FIG. 3 is an exploded perspective view of the waveguide-to-microstrip transition of the present invention.

Referring to FIG. 3, package 30 is constructed in three parts which has the decided advantage of a lower assembly cost. A cover 60 is placed upon ring frame 50. Cover 60 provides the covering for both the RF components of package 30 as well as for the backshort for transition 39. An opening 61 is provided for the waveguide. Moreover, a trough 62 allows substrate 34 to be accurately aligned with base 52. Substrate 34 is eutectically soldered or epoxied to base 52 for a hermetic seal. A second substrate 64 with the same configuration as substrate 34 is shown.

Optimal coupling of RF power to and from package 30 is accomplished by making use of available iris resonances due to excited higher-order modes and the terminating of the microstrip line 40 in a short circuit at the edge of iris 48 (of FIG. 2) using first stub 38. Thus, the need for high-tolerance backshort positioning is obviated. Impedance matching to the microstrip port 69 is accomplished using microstrip line 40, second stub 42 and third stub 44; rendering a very low-profile design. In this context, a very low-profile design indicates a planar microstrip design versus other designs such as ridged waveguide, or waveguides/coaxial/microstrip transitions.

Ring frame 50 encloses transition 39 with the exception of the opening for the microstrip line 40. Ring frame 50 which provides the perimeter for cavity 46 is assembled along with substrate 34 in one step. Another feature of transition 39 is that cover 60 is an integral part of package 30, and can be laser-welded in place, thus making transition 39 a fully integrated part of package 30 requiring no special assembly steps. These features render transition 39 to be very low-cost and readily integrable into typical microwave and mmW multi-chip assembly (MCA) packages.

In the preferred embodiment: substrate 34 is composed of alumina; with etched gold probe 36 and etched gold iris 48; ring frame 50 is a composition of Alloy 48 and 46; base 52 is of composition of AlSiC (cast) and CuMo (stamped) corresponding respectively. However, it is to be understood that the present invention is not limited to only those compositions referenced above, but includes other materials which produce similar results. For example, substrate 34 may also have the following compositions (but is not limited to): fused silica, Duroid (RT/duriod), or z-cut quartz.

Figure 4A:
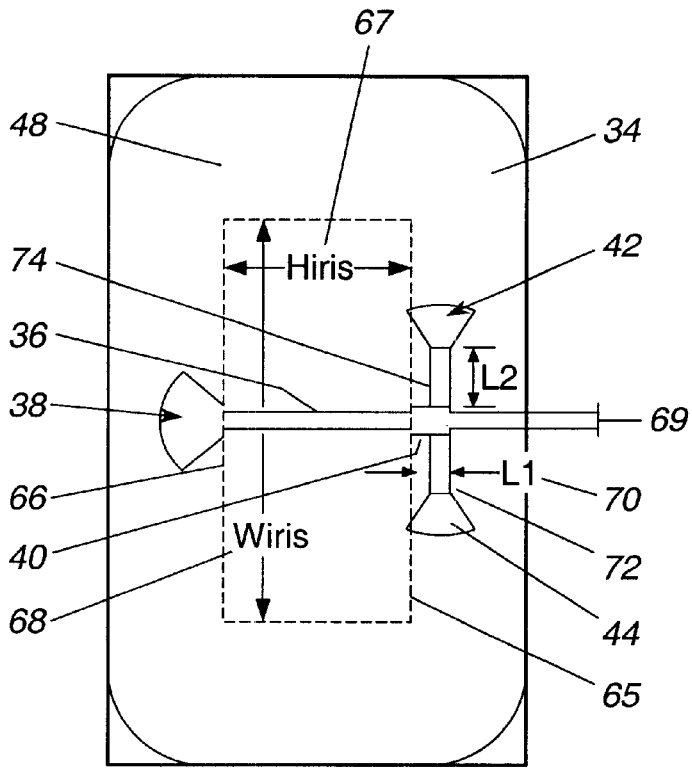
FIG. 4A is a top view of the waveguide-to-microstrip transition showing the network topology.

Referring to FIG. 4A, microstrip line 40 is situated along the E-plane of the waveguide, and is terminated in a short structure (i.e., first stub 38) coincident with edge 66 of iris 48 and connects to the main microstrip line (not shown). This ensures a zero voltage condition at edge 66, and in turn, maximum voltage across the opening of iris 48 and RF coupling to the signal transmitting line. Preferably, first stub 38 is a ninety degree stub. The probe 36, the stubs (38, 44, 42) and iris (48) are patterns formed from etching of gold metallization of both sides of the substrate 34.

The choice of iris height 67 ($H_{iris}$) and iris width 68 ($W_{iris}$) determines the upper bound for the bandwidth of the transition. Iris 48 was modeled as a shunt circuit, where the equivalent circuit parameters model the storage of susceptive energy caused by the non-propagating higher-order modes excited at the discontinuity. These shunt parameters are determined using a variational method such as that described in R. E. Collin, *Field Theory of Guided Waves,* McGraw-Hill, New York, ch. 8, 1960. Because of this total admittance, iris 48 has resonances of its own which can in turn be used to broaden the bandwidth of the transition (see, L. Hyvonen and A. Hujanen, *"A Compact MMIC-Compatible Microstrip to Waveguide Transition"*, IEEE MTT-S Int'l Symposium Digest, San Francisco, Calif., vol. 2, pp. 875–878, 1996.

The optimal choice of dimensions of iris 48 is accomplished using a 3D electromagnetic simulator based on Finite Element Method (FEM), such as Ansoft's Maxwell Eminence or Hewlett-Packard's HFSS.

Matching of the impedance presented by iris 48 to the microstrip is port 69 is accomplished by using two symmetrical shunt lines 72 and 74 which are short-circuited using second and third stubs (42 and 44). Shunt lines 72 and 74 are a predetermined distance 70 ($L_1$) away from edge 65. This distance is chosen so that at point a:

$$Y_a = Y_0 + jB_a, \tag{EQ1}$$

where $Y_0$ is the characteristic admittance of the microstrip line 40. The lengths of shunt lines 72 and 74 ($L_2$) are chosen such that they each present:

$$j\frac{B_a}{2}[mhos] \tag{EQ 2}$$

to microstrip line 40 at $f_0$, where $B_a$ is the susceptance from (EQ 1). The use of two symmetrical shunt lines 72 and 74 in parallel assist in keeping the response broadband due to the higher series reactance seen by microstrip line 40:

$$X_a = \frac{2}{B_a}[\text{ohms}]. \tag{EQ 3}$$

In alternate embodiments, fine tuning of the response with respect to $f_0$ is implemented by varying $W_{iris}$ 68 accordingly.

Figure 5:
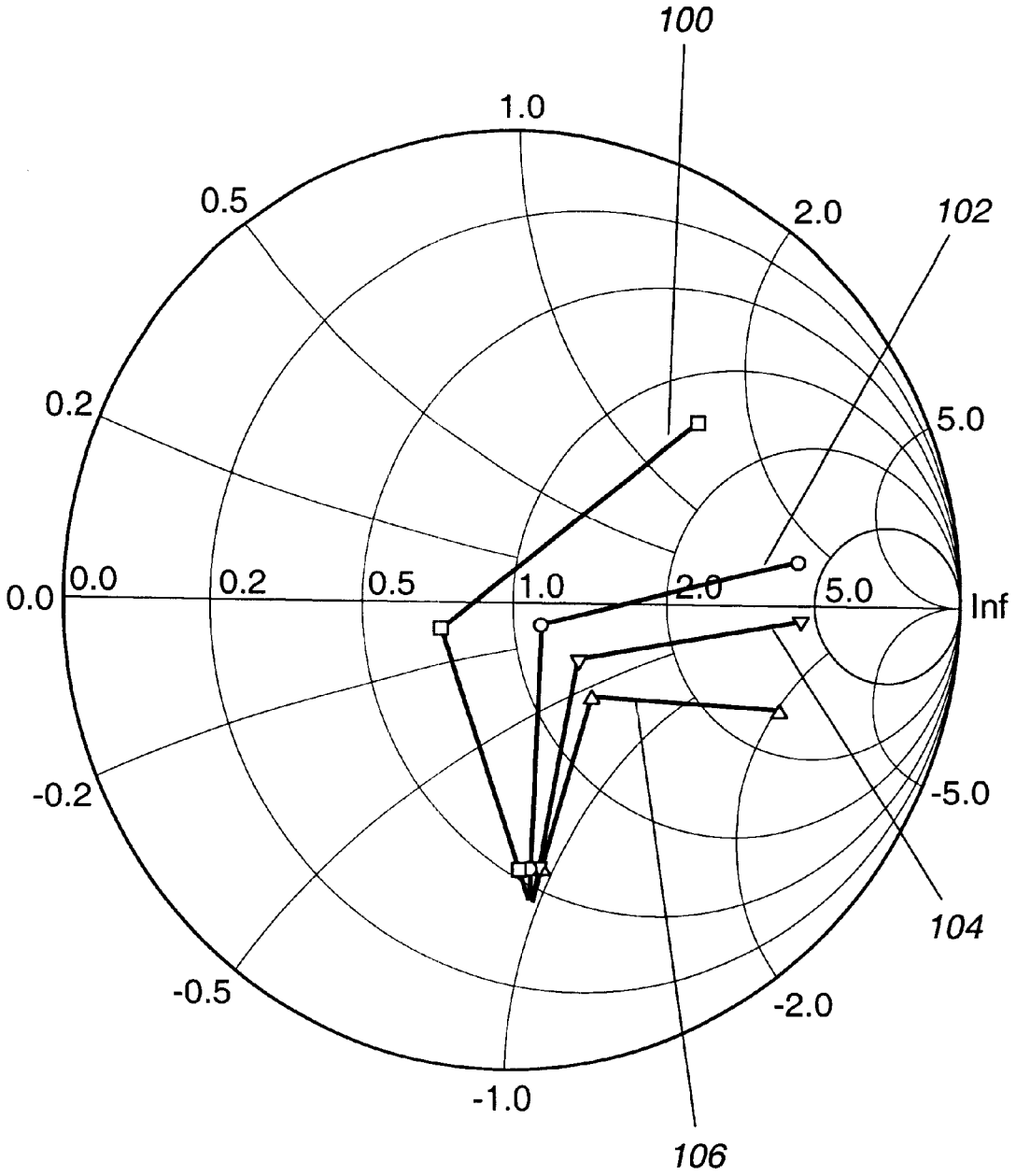
FIG. 5 is a Smith chart used to determine the W-band dimensions for the iris.

Referring to FIG. 5, the input impedance referenced to the near edge of the iris is plotted on a Smith Chart parametrically as a family of curves for each $H_{iris}$ as a function of $W_{iris}$, $Z_{in}(W_{iris})(H_{iris}$. For the W-band design, choosing a curve with the least variation in $Z_{in}(W_{iris})H_{iris}$ is equivalent to choosing the iris dimensions that will afford the broadest bandwidth for the matched transition.

Curve 100 depicts the following three points which pair $H_{iris}$ with $W_{iris}$: (20.0 mils, 70 mils); (20.0 mils, 80 mils); and (20.0 mils, 90 mils). Curve 102 depicts the following three points which pair $H_{iris}$ with $W_{iris}$: (25.0 mils, 70 mils);

(25.0 mils, 80 mils); and (25.0 mils, 90 mils). Curve 104 depicts the following three points which pair $H_{iris}$ with $W_{iris}$: (27.5 mils, 70 mils); (27.5 mils, 80 mils); and (27.5 mils, 90 mils). Curve 106 depicts the following three points which pair $H_{iris}$ with $W_{iris}$: (30.0 mils, 70 mils); (30.0 mils, 80 mils); and (30.0 mils, 90 mils). Curve 106 exhibits at $H_{iris}$ equal to 30.0 mils the least variation as a function of $W_{iris}$. When the iris is implemented with an $H_{iris}$ of 30.0 mils and an $W_{iris}$ of 80 mils, the present is invention provides for broadband performance.

Figure 4B:
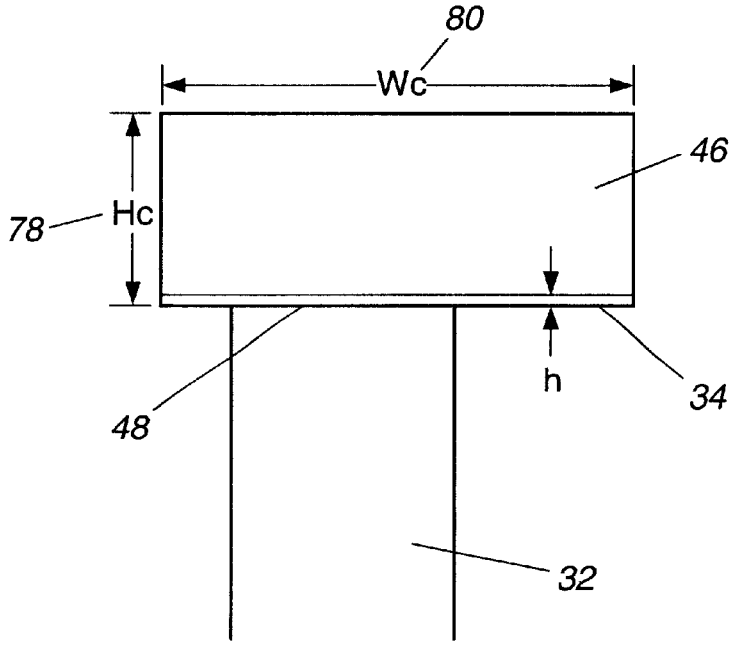
FIG. 4B is a side view of the waveguide-to-microstrip transition depicting the waveguide and cavity dimensions.

Referring to FIG. 4B, the dimensions of cavity 46 (i.e., cavity height ($H_c$) 78 and cavity width ($W_c$) 80) are selected such that its modal resonances are not too close to the operating frequency. Usually, resonances are chosen such that:

$$\left|\frac{f_o f_{resi}}{f_o}\right| \geq 0.1;\ i = 1, 2$$

where $f_0$ is the center operating frequency, and the $f_{resi}$ are the two closest resonances bounding the center frequency. Because of the relative isolation of cavity 46 from waveguide 32 due to iris 48, the present invention has the distinct advantage that the exact height of the backshort (i.e. $H_c$ 78) is not crucial to the electrical performance of the transition.

A Q-band design on 5 mil alumina ($E_r$=9.9), and a W-band design on 5 mil z-cut quartz ($E_r$=4.7) are discussed below. Models of these two designs were simulated using 3D FEM simulators, employing a relatively strict convergence criteria. S-parameter measurements of the transitions were facilitated by employing two identical transitions fixed in a back-to-back arrangement (as shown for example in FIG. 3, where the two transitions would be connected through a 50 ohm microstrip line, rather than the active MMIC devices shown). The transitions are connected using a 50 Ohm microstrip line, 955 mils long for the Q-band fixture and 830 mils long for the W-band fixture, to allow the distinct characterization of the transitions without any interactive effects.

Figure 6:
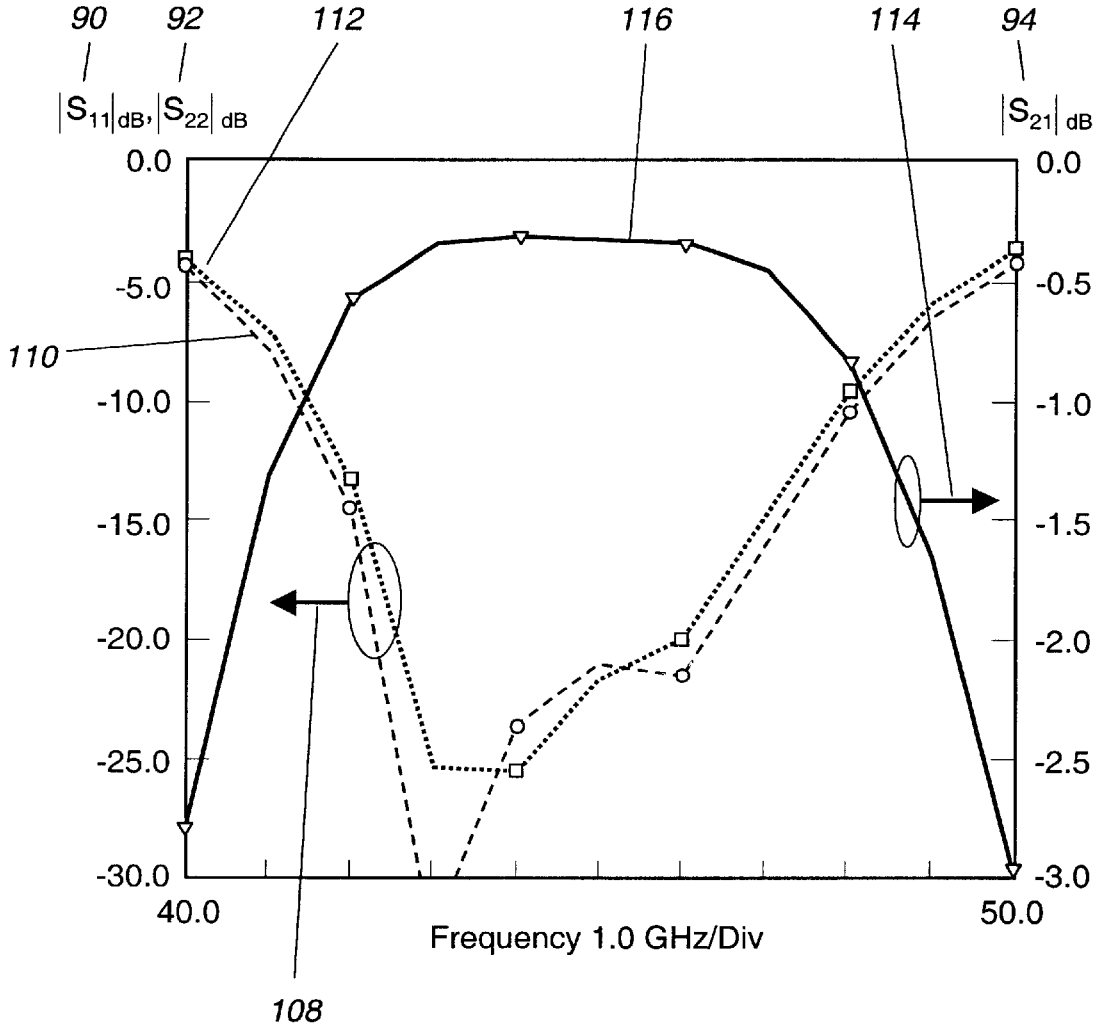
FIG. 6 is an X-Y graph illustrating the predicted results of the Q-band transition.

FIG. 6 shows the theoretical values of:
$|S_{11}|_{db}$ (Reference 90)$|S_{22}|_{db}$ db (Reference 92) and
$|S_{21}|_{db}$ (Reference 94)
for the Q-band transition. Indicator 108 indicates that curves 110 and 112 use the leftmost ordinate values. Reference 90 which is curve 110 represents the reflection coefficient from the waveguide; reference 92 which is curve 112 represents the reflection coefficient from the microstrip line; and reference 94 which is curve 116 represents the transmission characteristics. Indicator 114 indicates that curve 116 uses the rightmost ordinate values. Theoretical dielectric and planar conductor losses are accounted for in the model simulation. The frequency rate is approximately in the 44 GHz region. For a 15 dB return loss, a bandwidth greater than 10% is predicted. The insertion loss of the transition throughout the band of interest is ~0.35 dB.

Figure 7:
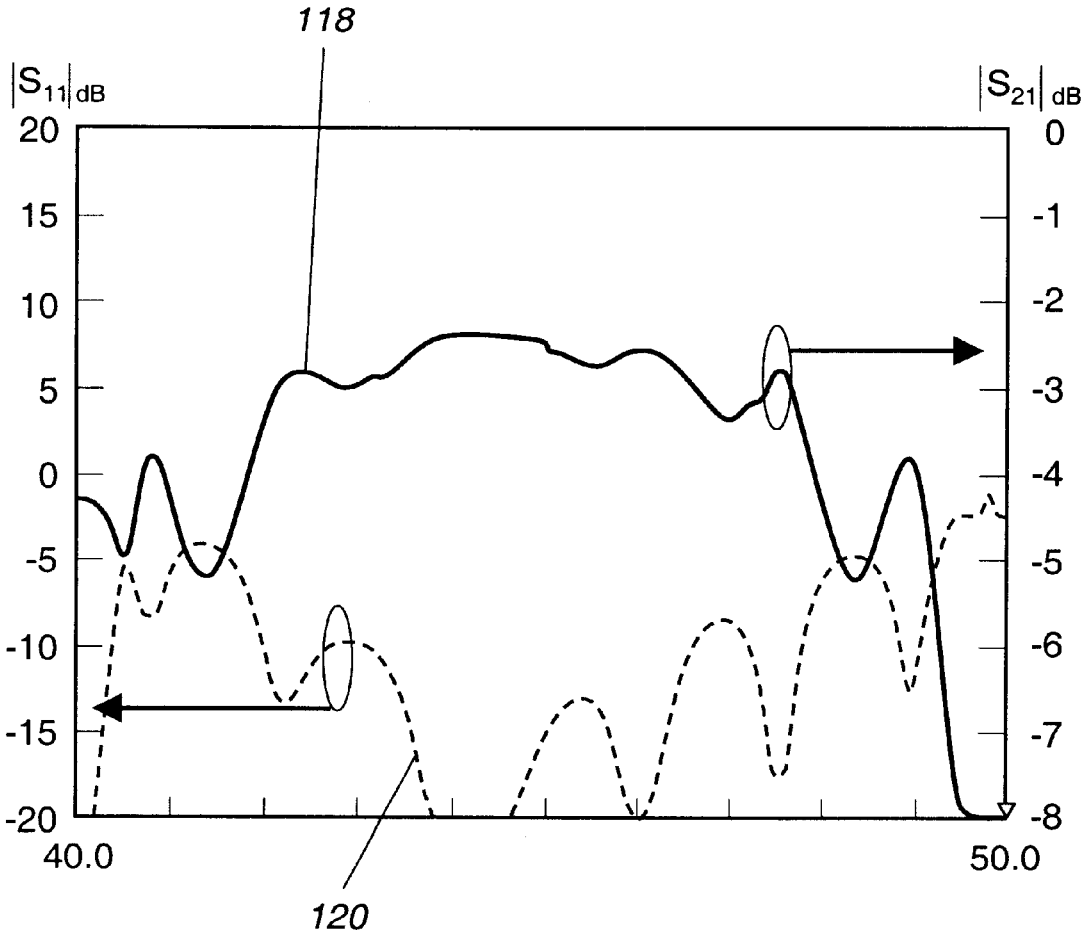
FIG. 7 is an X-Y graph showing the measured data of two back-to-back Q-band transitions.

FIG. 7 shows the Q-band measured data of two back-to-back transitions obtained on an automated network analyzer (ANA). The measured results corresponding to one transition can be determined from the back-to-back transitions data. Curve 118 represents the insertion loss. Curve 120 represents reflection coefficient. The curve 118 is identified by the values on the right vertical axis and the curve 120 is identified by the values on the left vertical axis. By accounting for the microstrip fine and test fixture losses based on separate measurements (1.8 dB/in and 0.2 dB, respectively, at 44 GHz), the return and insertion losses of one transition can be calculated. A 10% bandwidth is deduced for a 15 dB return loss, and the insertion loss per transition is found to be less than 0.3 dB. Around the center of the band, a return loss better than 22 dB has been obtained.

Figure 8:
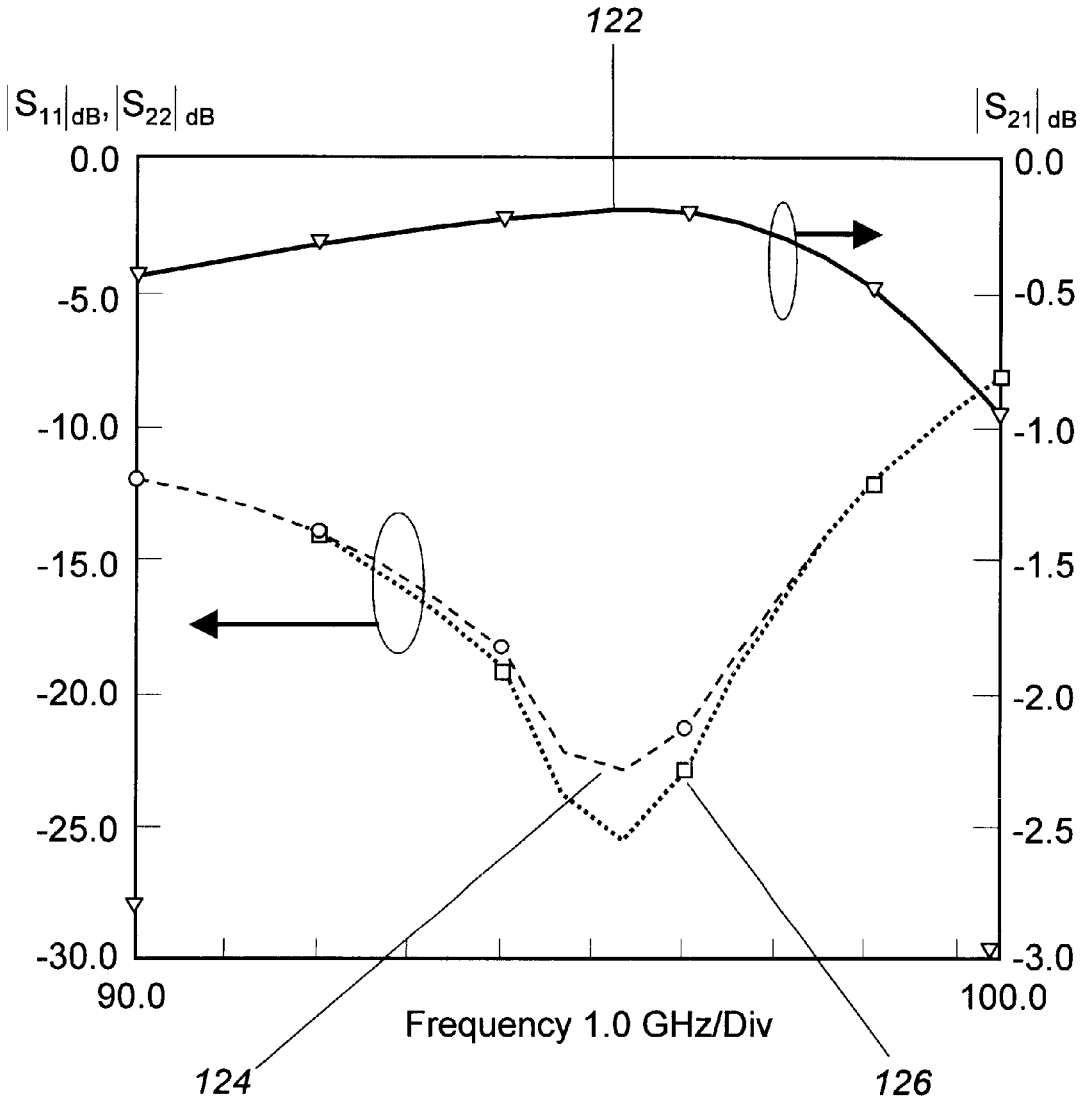
FIG. 8 is an X-Y graph showing the predicted results of the W-band transition.

FIG. 8 shows the theoretical values for the W-band transition including loss. Curve 122 represents the insertion loss response. Curve 124 represents the output reflection coefficient. Curve 126 represents the input reflection coefficient. The curve 122 is identified by the values on the right vertical axis and the curves 124 and 126 are identified by the values on the left vertical axis. The frequency rate is approximately in the 94 GHz region. For a 15 dB return loss bandwidth, an insertion loss better than 0.35 dB can be achieved. The W-band design was implemented on a lower permittivity substrate (z-cut quartz) for bandwidth considerations. The higher overall circuit Q in this frequency band leads to a narrower response than that at Q-band. The higher overall circuit Q in this frequency band leads to a narrower response than that at Q-band.

Figure 9:
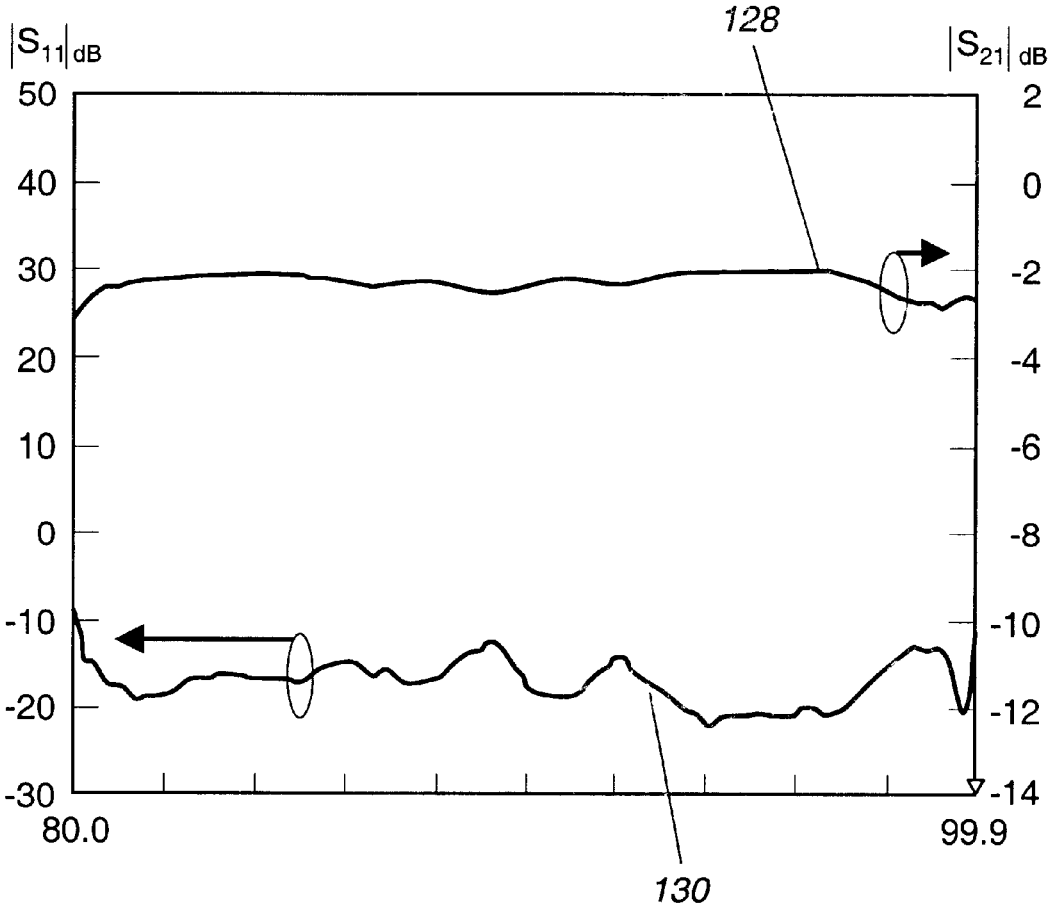
FIG. 9 is an X-Y graph showing the measured data of two back-to-back W-band transitions.

FIG. 9 shows the W-band back-to-back transitions measured data. Curve 128 represents insertion loss. Curve 130 represents input reflection coefficient. The curve 128 is identified by the values on the right vertical axis and the curve 130 is identified by the values on the left vertical axis. From these, the frequency response of the transitions exhibits a relatively wider and flatter bandwidth than that shown in FIG. 8. A 12% bandwidth with a 15 dB return loss can be deduced. The insertion loss is found to be less than 0.2 dB per transition, using a value of 1.61 dB/in for the microstrip line and test fixture losses at 94 GHz.

Figure 10:
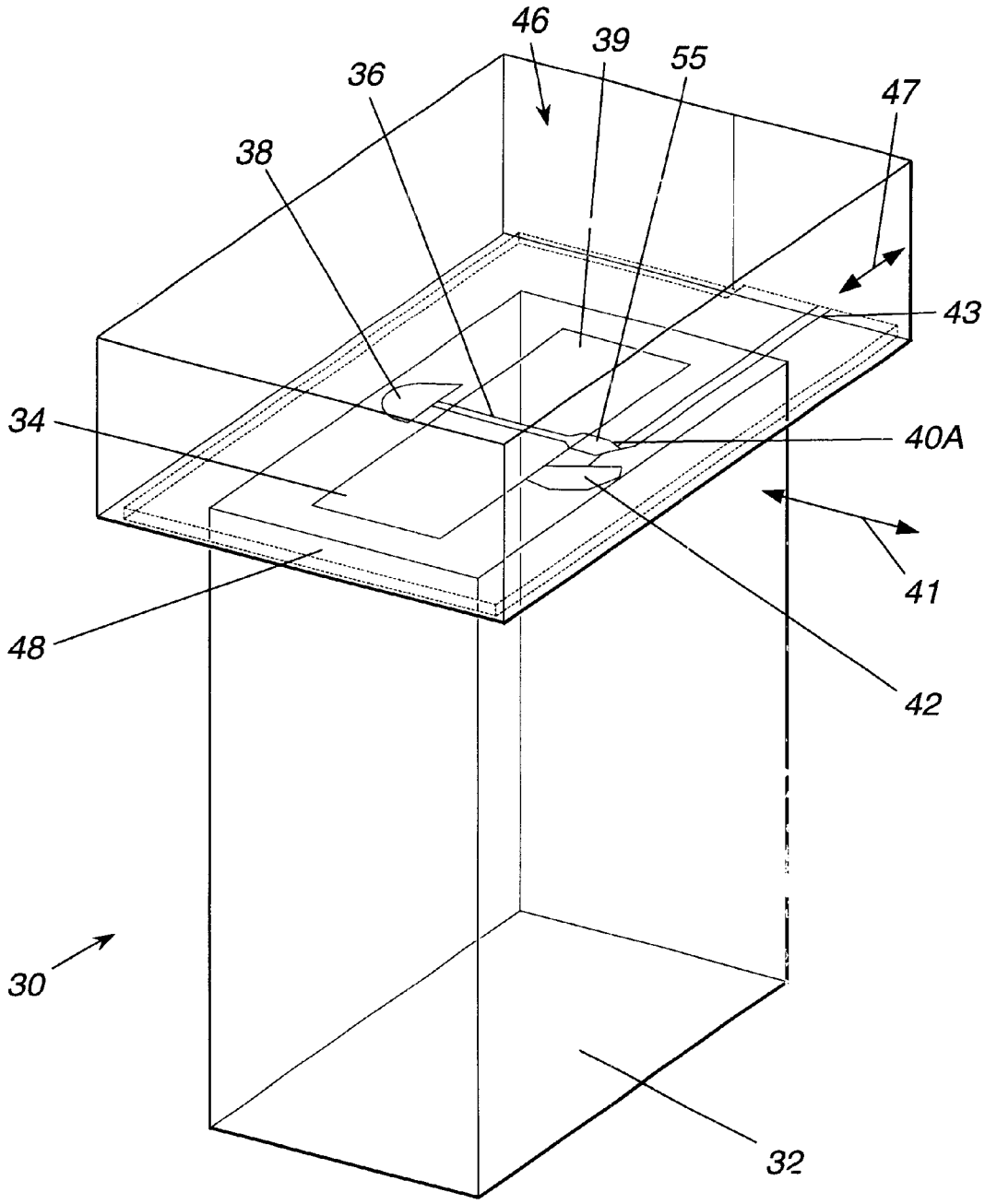
FIG. 10 is a diagrammatic perspective of an alternate embodiment of the present invention.

FIG. 10 depicts an alternate embodiment of the present invention wherein waveguide-to-microstrip transition package 30 includes a bent microstrip line 40A. Bent microstrip line 40A allows signals to be directed to an output port 43 which is not substantially inline (i.e., offset) with axis 41 of probe 36. Output port has an axis 47 which is not inline with axis 41. In this respect, axis 47 is at an angle other than 180 degrees. Preferably, axis 47 is at approximately a right angle (i.e., approximately 90 degrees) with respect to axis 41.

In this embodiment, probe 36 on substrate 34 with iris 48 collects the incoming signals from the waveguide opening 32 in the E-Plane direction of propagation. Microstrip line 40A has an angled bend with a short circuit stub 42, such as a radial stub, to provide signal matching which changes the signal direction. Radial stub 42 is modified so that the impedance between the probe and the microstrip line is substantially matched.

It should be appreciated that the present invention is not limited to a microstrip line with a bend of approximately 90 degrees, but includes bends of whatever angle is needed in order to provide the redirection of signals to the output port. Moreover, the present invention includes the waveguide being in a shape other than rectangular, such as, but not limited to, a circular shape.

Additionally, the present invention includes, but is not limited to, the advantage of a size reduction since the redirection to the side output port is being performed within the transition itself.

The non-limiting example of FIG. 10 illustrates the change in signal direction from inline to a side output port 43. The side output port 43 serves as an outlet for directing the signal from the microstrip line 40A to electronic wave processing hardware. Such electronic wave processing hardware (e.g., RF components) is shown, for example, in FIG. 3 at reference numeral 53.

The present invention includes the alternate embodiment with a bent microstrip line 40A being utilized within the system depicted in FIG. 3 where, for example, cover 60 of FIG. 3 provides the covering for both the RF components of package 30 as well as the backshort for transition 39. Moreover, the present invention includes the alternate embodiment, being utilized with trough 62 (of FIG. 3) which allows substrate 34 to be accurately aligned with base 52.

Figure 11:
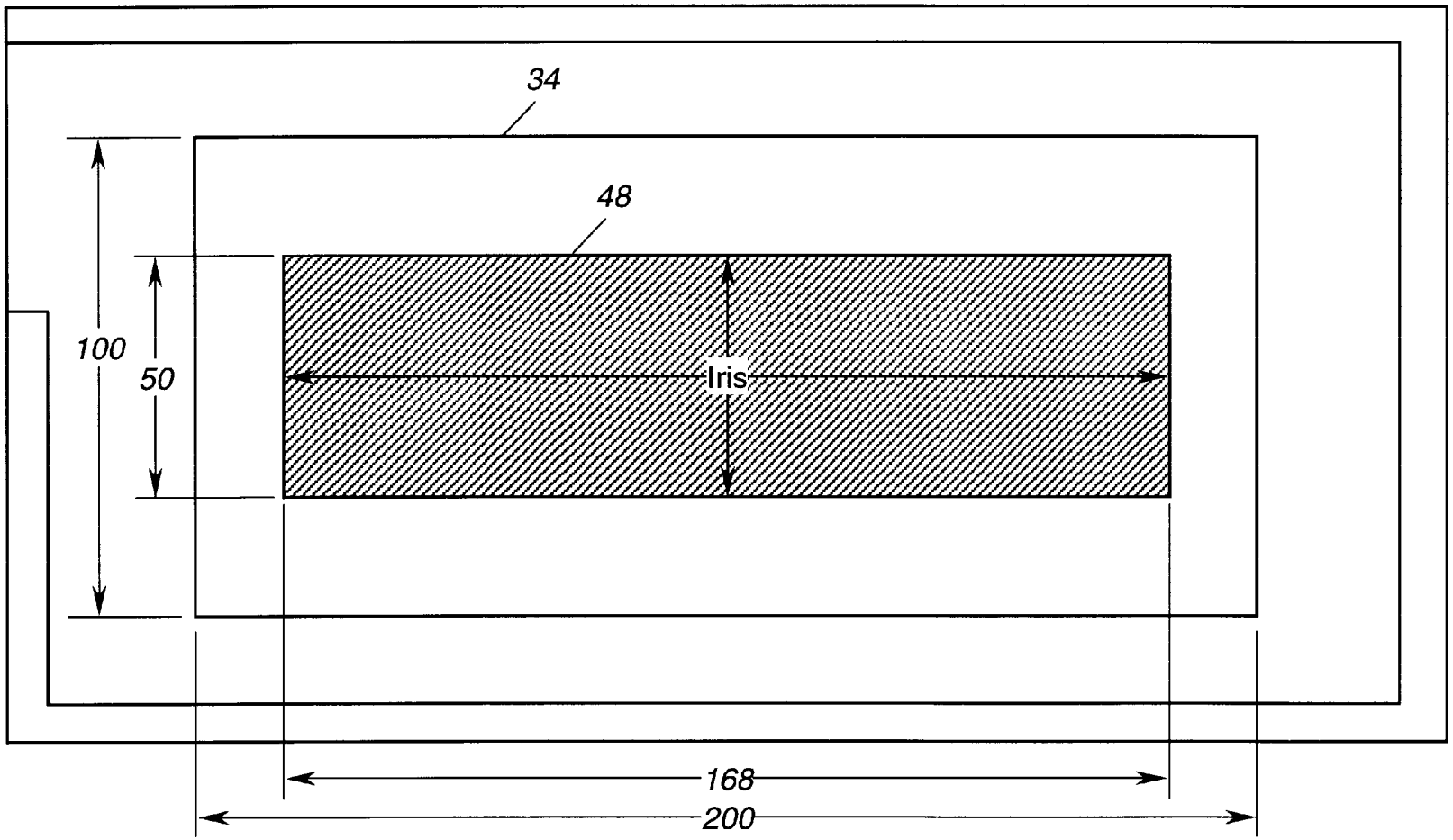
FIG. 11 is a bottom-view of the alternate embodiment of FIG. 10.

FIG. 11 depicts the preferred embodiment for the geometric characteristics of the alternate embodiment for the bent microstrip line 40A. The dimensions are in units of mils (i.e., thousandths of an inch). Particularly, the iris 48 has a length of 168 mils and a width of 50 mils, and the substrate 34 has a length of 200 mils and a width of 100 mils. It is to be understood that while these dimensions are the preferred dimensions, the present invention is not limited to these dimensions since the dimensions are subject to change based upon the particular application.

Figure 12:
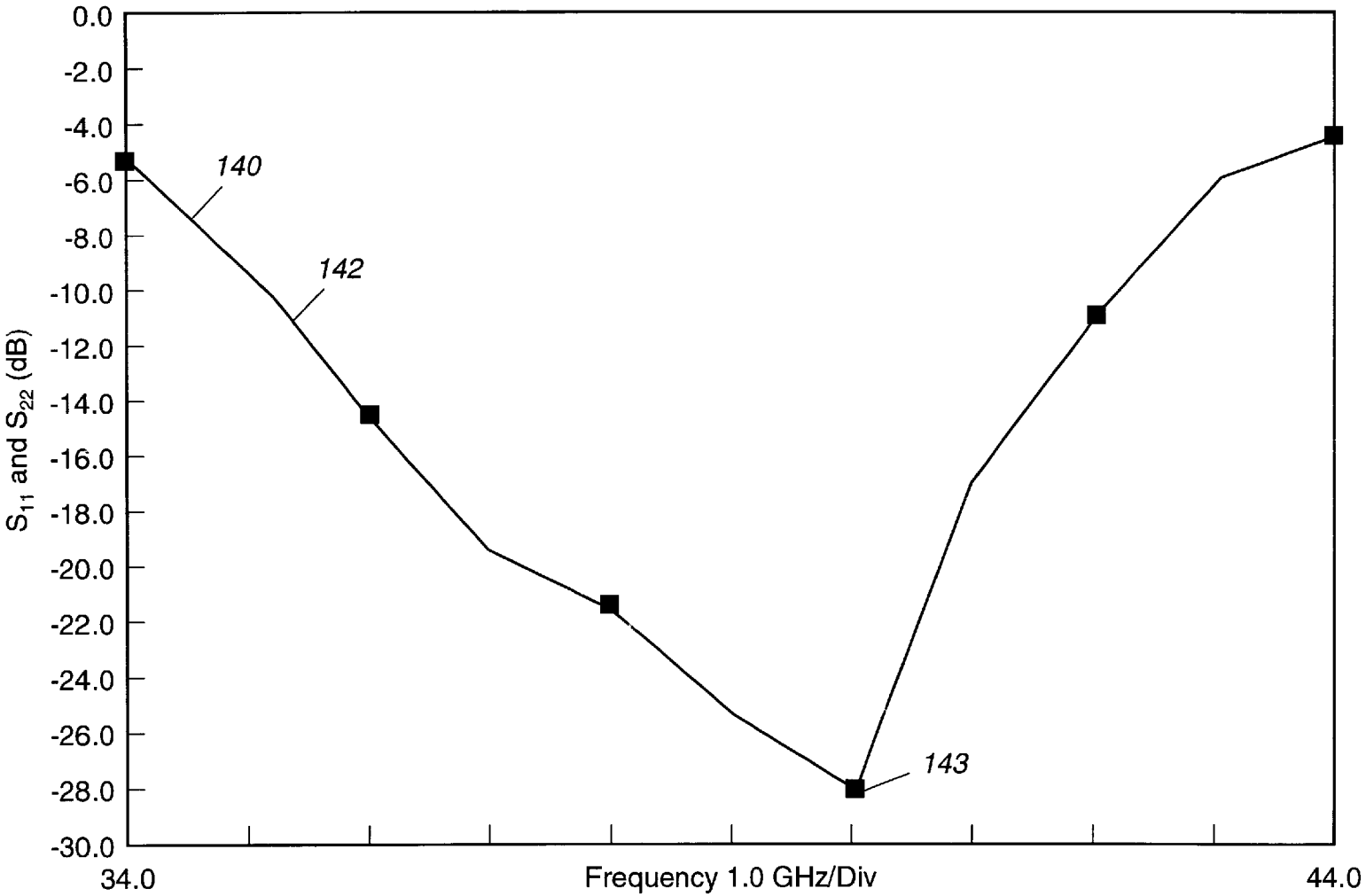
FIG. 12 is an X-Y graph depicting the reflection characteristics of the alternate embodiment of FIG. 10.
Figure 13:
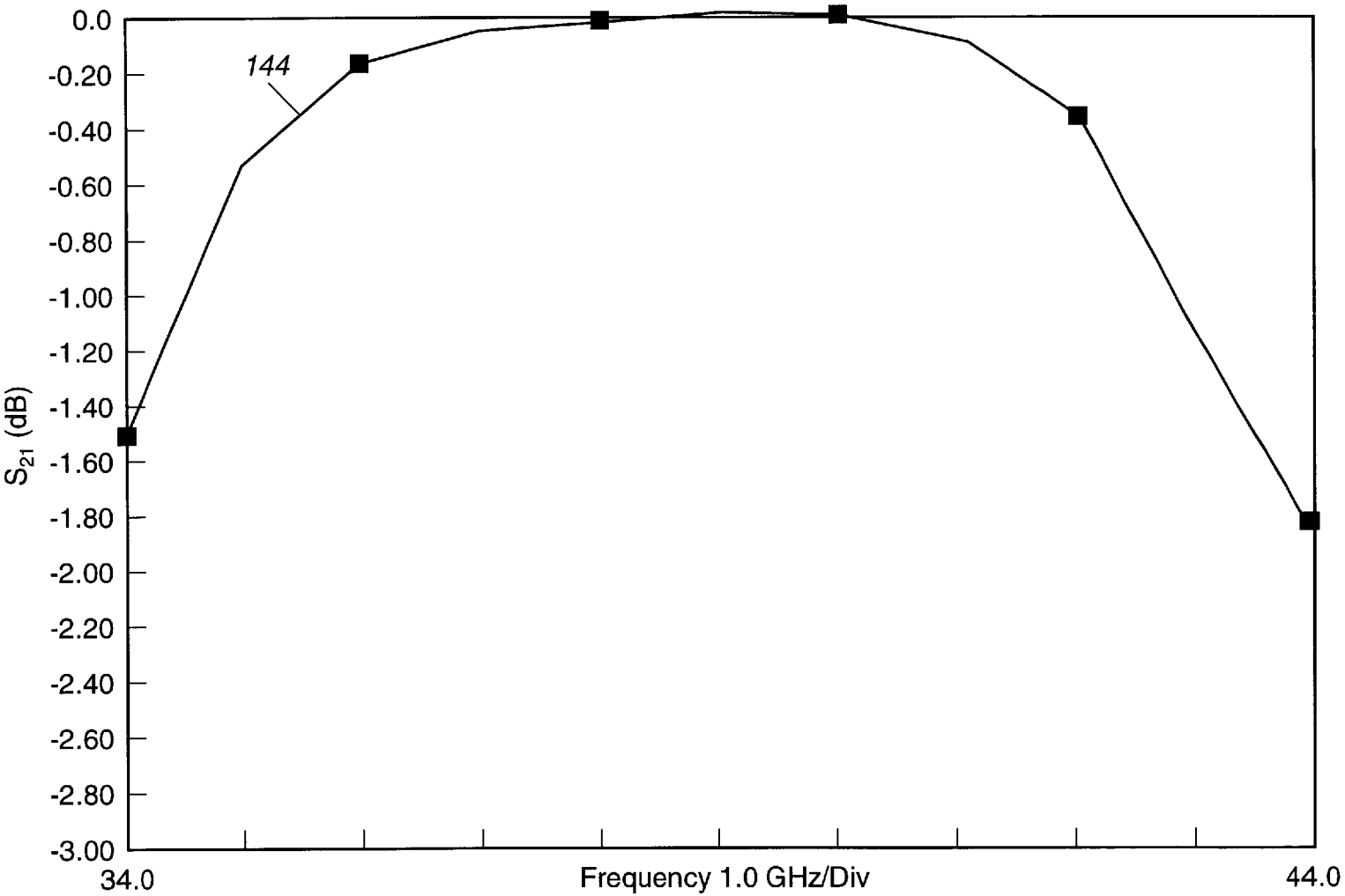
FIG. 13 is an X-Y graph depicting the insertion loss characteristics of the alternate embodiment of FIG. 10.

FIGS. 12 and 13 graphically depict the simulated theoretical values for the alternate embodiment for operation in the frequency range of 34.0–44.0 GHz. Within the exemplary graphical results of FIGS. 12 and 13, the present invention was utilized within a system whose design frequency was approximately 38–39 GHz.

S curve 140 represents the output reflection coefficient (i.e., reflection from the waveguide). S curve 142 represents the input reflection coefficient (i.e., reflection from the microstrip line). Point 143 on FIG. 12 depicts that at approximately 40 GHz, the reflection is at approximately −29 dB (i.e., relatively little reflection which results in higher amount of incident power being conducted through the microstrip line). With reference to FIG. 13, S curve 144 represents the insertion loss response. These graphical results are shown in the following table:

| Frequency GHz | S[1,1] Mag | S[1,1] Ang deg | S[2,2] Mag | S[2,2] Ang deg | S[1,2] dB | S[1,2] Ang deg |
|---|---|---|---|---|---|---|
| 34.000000000 | 0.5410 | 108.7709 | 0.5410 | 65.5533 | −1.5038 | 177.1621 |
| 35.000000000 | 0.3452 | 97.3707 | 0.3452 | 38.7942 | −0.5510 | 158.0825 |
| 36.000000000 | 0.1878 | 97.1521 | 0.1878 | 3.5057 | −0.1559 | 140.3290 |
| 37.000000000 | 0.1083 | 116.1758 | 0.1083 | −47.0908 | −0.0512 | 124.5425 |
| 38.000000000 | 0.0851 | 133.0327 | 0.0851 | −92.5847 | −0.0316 | 110.2239 |
| 39.000000000 | 0.0536 | 122.7337 | 0.0536 | −109.7834 | −0.0125 | 96.4751 |
| 40.000000000 | 0.0396 | 13.2710 | 0.0396 | −28.3049 | −0.0068 | 82.4830 |
| 41.000000000 | 0.1436 | −31.1052 | 0.1436 | −13.4411 | −0.0905 | 67.7268 |
| 42.000000000 | 0.2835 | −48.5364 | 0.2835 | −27.5465 | −0.3639 | 51.9585 |
| 43.000000000 | 0.4874 | −71.9448 | 0.4874 | −19.5502 | −1.1777 | 44.2525 |
| 44.000000000 | 0.5878 | −78.9184 | 0.5878 | −55.9906 | −1.8410 | 22.5455 |

The embodiments which have been set forth above were for the purpose of illustration and were not intended to limit the invention. It will be appreciated by those skilled in the art that various changes and modifications may be made to the embodiments discussed in the specification without departing from the spirit and scope of the invention as defined by the appended claims. For example, the present invention also includes the probe being in the shape of a wedge instead of being in a linear shape.

It is claimed:

1. A waveguide-to-microstrip transition for converting and directing electromagnetic wave signals to a signal processing component, comprising:

a waveguide for directing said electromagnetic wave signals to a waveguide input;

a substrate positioned on the waveguide and including an iris;

a probe formed on the substrate for receiving said directed electromagnetic wave signal, said probe including a widened shorting stub portion and an elongated portion, said shorting stub portion being connected at one end of the elongated portion, said shorting stub portion being mounted on the substrate and said elongated portion extending across the iris;

a bent microstrip line connected to said probe for directing said received electromagnetic wave signals from said probe to said electronic signal processing component, and a first stub and second stub being disposed on a substrate;

whereby said first and second stubs have been short-circuited for substantially matching an impedance of said probe and an impedance of said bent microstrip line, an output port for providing a connection between said bent microstrip line and said electronic signal processing component, said output port not being inline with respect to the probe, said probe transitioning into said bent microstrip line along a first axis, said output port having a second axis which is at an angle other than 180 degrees from said first axis, said bent microstrip line including a bend so as to direct said received signals along the first axis of said probe to the second axis of said output port.

2. A waveguid-to-microstrip transition for converting and directing electromagnetic wave signals to an electronic signal processing component, comprising:

a waveguide for directing said electromagnetic wave signals to a waveguide input;

a substrate positioned on the waveguide and including an iris;

a probe formed on the substrate for receiving said directed electromagnetic wave signals, said probe including a widened shortinq stub portion and an elongated portion, said shorting stub portion being connected at one end of the elongated portion, said shorting stub portion being mounted on the substrate and said elongated portion extending across the iris;

a bent microstrip line connected to an end of the elongated portion of said probe opposite the shorting stub for directing said received electromagnefic wave signals from said probe to said electronic signal processing component, and an output port for providing a connection between said bent microstrip line and said electronic signal processing component, said output port being offset with respect to the probe, said bent microstrip line including a bend so as to direct said received electromagnetic wave signals from said probe to said output port, wherein said probe transitions into said bent microstrip line along a first axis, said output port having a second axis which is at an angle other than 180 degrees from said first axis, said bent microstrip line directing said received signals along the first axis of said probe to the second axis of said output port.

3. The transition according to claim 1, said transition further comprising:

a first stub and second stub being disposed on said substrate proximate the bent microstrip line;

whereby said first and second stubs provide for matching an impedance of said probe and an impedance of said bent microstrip line.

4. The transition according claim 2 wherein said substrate is hermetically sealed to said waveguide.

5. The transition according to claim 4 wherein said transition is incorporated into a package and wherein the electronic signal processing component includes components selected from the group consisting of radio frequency components, microwave frequency components, or millimeter frequency components.

6. The transition according to claim 5 wherein the electronic signal processing component includes at least one integrated circuit chip for processing said electromagnetic wave signals from said probe.

7. The transition according to claim 4 further comprising:

a base, wherein said substrate is eutectically soldered to said base thereby providing said hermetic seal with said base.

8. The transition according to claim 4 further comprising:

a base having a trough surrounding said waveguide input, said substrate being insertable into said trough thereby providing said hermetic seal between said base and said substrate.

9. The transition according to claim 8 wherein said substrate is eutectically soldered to said base to provide said hermetic seal with said base.

10. The transition according to claim 4 wherein said probe is etched onto said substrate.

11. The transition according to claim 4 further comprising:

a frame connected to said substrate, said frame defining a cavity which contains said probe; and a cover which is fastened onto said frame, said cover providing both a backshort and a seal for said transition.

12. The transition according to claim 10 wherein said substrate overlaps said waveguide input thereby providing said hermetic seal.

13. The transition according to claim 11 wherein the iris is substantially disposed in said cavity for substantially matching the impedance of said probe and the impedance of said bent microstrip line.

14. The transition according to claim 13 further comprising:

a first stub and second stub disposed on said substrate proximate the bent microstrip line;

whereby said first and second stubs providing for matching the impedance of said probe and the impedance of said bent microstrip line.

15. The transition according to claim 14 wherein said substrate has a first side and a second side, said probe being etched onto the first side of said substrate, said iris being appended onto the second side of said substrate.

* * * * *

UNITED STATES PATENT AND TRADEMARK OFFICE

CERTIFICATE OF CORRECTION

PATENT NO. : 6,486,748 B1 
DATED : November 26, 2002
INVENTOR(S) : David I. Stones and Jerry M. Dickson It is certified that error appears in the above-identified patent and that said Letters Patent is hereby corrected as shown below:

Column 1,
Line 5, insert:
-- This invention was made with Government support under contract number DAAH01-95-C-R200 awarded by the United States Army Aviation & Missile Command. The Government has certain rights in this invention. --.

Signed and Sealed this

Seventh Day of February, 2006

JON W. DUDAS
*Director of the United States Patent and Trademark Office*